US008720392B2

(12) United States Patent
Tiefenthaler et al.

(10) Patent No.: US 8,720,392 B2
(45) Date of Patent: May 13, 2014

(54) ENGINE BLOWER SCROLL

(71) Applicant: Briggs & Stratton Corporation, Wauwatosa, WI (US)

(72) Inventors: Carl T. Tiefenthaler, Jackson, WI (US); Benjamin R. Miller, Hartland, WI (US); Chad J. Gartzke, Wauwatosa, WI (US); John R. Schneiker, Muskego, WA (US); Greg Hupfer, Jackson, WI (US); David W. Branski, New Berlin, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 13/773,368

(22) Filed: Feb. 21, 2013

(65) Prior Publication Data

US 2013/0160748 A1 Jun. 27, 2013

Related U.S. Application Data

(63) Continuation of application No. 12/508,400, filed on Jul. 23, 2009, now Pat. No. 8,424,498.

(51) Int. Cl.
*F01P 1/00* (2006.01)

(52) U.S. Cl.
USPC ..... 123/41.56; 123/41.65; 123/559.1

(58) Field of Classification Search
USPC ..... 123/41.56, 41.7, 41.63, 41.44, 41.01, 123/41.11, 41.47, 41.48, 41.49, 41.6
See application file for complete search history.

(56) References Cited

U.S. PATENT DOCUMENTS

| | | | |
|---|---|---|---|
| 2,549,482 | A | 4/1951 | Kiekhaefer |
| 2,699,764 | A | 1/1955 | Keikhaefer |
| 2,747,558 | A | 5/1956 | Keikhaefer |
| 2,758,580 | A | 8/1956 | Balzer |
| 3,091,226 | A | 5/1963 | Jepson |
| 3,245,390 | A | 4/1966 | Roorda et al. |
| 3,586,238 | A | 6/1971 | Schmierer et al. |
| 4,120,274 | A | 10/1978 | De Lancey |

(Continued)

FOREIGN PATENT DOCUMENTS

| | | | |
|---|---|---|---|
| JP | 63088224 | A | 4/1988 |
| WO | WO-2008/063106 | A1 | 5/2008 |

OTHER PUBLICATIONS

Communication Relating to the Results of the Partial International Search for Application No. PCT/US2010/041684, date of mailing Jul. 15, 2011, 2 pages.

(Continued)

*Primary Examiner* — Noah Kamen
*Assistant Examiner* — Long T Tran
(74) *Attorney, Agent, or Firm* — Foley & Lardner LLP

(57) ABSTRACT

A blower system for an engine includes a base of a blower scroll coupled to an engine crankcase. The base has a bottom wall with an opening sized to accommodate an end of a crankshaft. The base also has a sidewall extending away from the crankcase. The blower system further includes a blower housing fastened to the base, without the use of threaded fasteners. Together the blower housing and the base form a chamber having an inlet and an outlet. Also, the blower system includes a fan within the chamber. The fan is driven by the crankshaft and is designed to direct a flow of air through the outlet of the chamber.

20 Claims, 6 Drawing Sheets

(56) References Cited

U.S. PATENT DOCUMENTS

| | | | | | |
|---|---|---|---|---|---|
| 4,382,333 | A | | 5/1983 | Nagashima et al. | |
| 4,438,733 | A | | 3/1984 | Sasaki | |
| 4,590,890 | A | | 5/1986 | Tamba et al. | |
| 4,841,929 | A | | 6/1989 | Tuggle et al. | |
| 4,859,886 | A | | 8/1989 | Tanaka et al. | |
| 4,913,112 | A | | 4/1990 | Iida | |
| 4,995,356 | A | | 2/1991 | Kronich | |
| 5,070,686 | A | | 12/1991 | Isaka et al. | |
| 5,269,665 | A | | 12/1993 | Sadler et al. | |
| 5,367,988 | A | * | 11/1994 | Collins | 123/41.65 |
| 5,373,427 | A | * | 12/1994 | McLean | 362/96 |
| 5,383,427 | A | * | 1/1995 | Tuggle et al. | 123/51 BA |
| 5,438,825 | A | * | 8/1995 | Bloemers | 60/272 |
| 5,533,869 | A | | 7/1996 | Garrison et al. | |
| 5,905,758 | A | | 5/1999 | Schweiter et al. | |
| 5,950,578 | A | | 9/1999 | Hirano et al. | |
| 6,082,312 | A | | 7/2000 | Singer et al. | |
| 6,192,840 | B1 | | 2/2001 | Durr et al. | |
| 6,216,778 | B1 | | 4/2001 | Corwin et al. | |
| 6,279,522 | B1 | | 8/2001 | Balzar et al. | |
| 6,314,922 | B1 | * | 11/2001 | Zimmermann et al. | 123/41.65 |
| 6,439,215 | B1 | | 8/2002 | Sato et al. | |
| 6,470,848 | B2 | | 10/2002 | Takahashi et al. | |
| 6,595,178 | B2 | | 7/2003 | Araki | |
| 6,612,275 | B2 | | 9/2003 | Immel et al. | |
| 6,792,897 | B2 | | 9/2004 | Higuchi et al. | |
| 6,845,739 | B2 | * | 1/2005 | Nakamizo et al. | 123/41.56 |
| 6,868,821 | B2 | | 3/2005 | Maier et al. | |
| 6,871,697 | B2 | | 3/2005 | Albright et al. | |
| 6,952,056 | B2 | | 10/2005 | Brandenburg et al. | |
| 6,975,216 | B2 | | 12/2005 | Tharman et al. | |
| 6,998,725 | B2 | | 2/2006 | Brandenburg et al. | |
| 7,063,050 | B2 | | 6/2006 | Watanabe et al. | |
| 7,104,258 | B2 | | 9/2006 | Yamada et al. | |
| 7,191,753 | B2 | | 3/2007 | Sagara et al. | |
| 7,195,094 | B2 | | 3/2007 | Street et al. | |
| 7,201,132 | B2 | | 4/2007 | Miyake et al. | |
| 7,225,765 | B2 | | 6/2007 | Leech et al. | |
| 7,314,397 | B2 | | 1/2008 | Sodemann et al. | |
| 7,363,885 | B2 | | 4/2008 | Miyake et al. | |
| 2001/0035147 | A1 | | 11/2001 | Ito et al. | |
| 2002/0017283 | A1 | | 2/2002 | Furuya | |
| 2002/0020400 | A1 | | 2/2002 | Sato et al. | |
| 2002/0185093 | A1 | | 12/2002 | Immel et al. | |
| 2003/0070651 | A1 | | 4/2003 | Higuchi et al. | |
| 2004/0025827 | A1 | | 2/2004 | Davis | |
| 2004/0060525 | A1 | | 4/2004 | Maier et al. | |
| 2005/0132983 | A1 | | 6/2005 | Watanabe et al. | |
| 2005/0229893 | A1 | | 10/2005 | Miyake et al. | |
| 2006/0048742 | A1 | | 3/2006 | Sagara et al. | |
| 2006/0169256 | A1 | | 8/2006 | Lavender et al. | |
| 2006/0266308 | A1 | | 11/2006 | Leech et al. | |
| 2006/0288970 | A1 | | 12/2006 | Miyake et al. | |
| 2007/0169726 | A1 | | 7/2007 | Sugiyama | |
| 2007/0227470 | A1 | * | 10/2007 | Cole et al. | 123/3 |
| 2008/0093862 | A1 | | 4/2008 | Brandenburg et al. | |
| 2009/0235880 | A1 | * | 9/2009 | Ziegs | 123/41.65 |
| 2010/0059000 | A1 | * | 3/2010 | Bergquist | 123/41.65 |

OTHER PUBLICATIONS

International Search Report and Written Opinion for Application No. PCT/US2010/041684, mail date Aug. 18, 2011, 15 pages.

* cited by examiner

ENGINE BLOWER SCROLL

This is a continuation of application Ser. No. 12/508,400, filed Jul. 23, 2009, which is incorporated herein by reference in its entirety.

BACKGROUND

The present invention relates generally to the field of cooling systems for internal combustion engines. More specifically, the invention relates to blower scrolls for small engines, as used by rotary lawn mowers, pressure washers, secondary power generators, and the like.

Heat transfers from a combustion chamber within an engine to the surrounding cylinder, cylinder head, piston, crankcase, and other engine components. As such, engines are designed with cooling systems to prevent heat from concentrating in the components surrounding the combustion chamber. Cooling systems include lubrication systems, such as those that disperse motor oil within a crankcase, and air cooling systems. A blower fan serves as one type of air cooling system.

A blower fan is typically powered by an engine crankshaft. For example, the blower fan may be formed from fan blades extending from a flywheel that is spun by the crankshaft. The crankshaft spins the fan, which pulls air into the blower housing through a port. The spinning fan then drives the air to the walls of the blower. In some engines, a blower housing forms a scroll to direct the flow of air driven by the blower fan. An opening is formed in the blower scroll that directs air to cool the cylinder block and cylinder head. Typically, the cylinder and cylinder head include fins to enhance the heat dissipation into passing air. Also the directed flow of air helps to clear debris, such as loose grass clippings, from the crankcase and cylinder head.

SUMMARY

One embodiment of the invention relates to a blower system for an engine. The blower system includes a base of a blower scroll attached to an engine crankcase. The base has a bottom wall with an opening sized to accommodate an end of a crankshaft. The base also has a sidewall extending away from the crankcase. The blower system further includes a blower housing fastened to the base, without the use of threaded fasteners. Together the blower housing and the base form a chamber having an inlet and an outlet. Also, the blower system includes a fan within the chamber. The fan may be part of a flywheel driven by the crankshaft, or the fan may be a separate piece attached to the flywheel, where the fan is designed to direct a flow of air through the outlet of the chamber.

Another embodiment of the invention relates to an engine. The engine includes a base of a blower scroll attached to an engine crankcase. The base has a bottom with an opening and a sidewall extending away from the crankcase. Also, the engine includes a blower housing attached to the base, where the blower housing and the base together form a chamber of the blower scroll. The engine further includes a fan extending within the chamber. The fan is driven by a crankshaft that is extending through the opening in the bottom of the base. The chamber has an outlet oriented to direct a flow of air over a cylinder block. Additionally, the engine also includes a fuel tank attached to the sidewall of the base.

Yet another embodiment of the invention relates to an engine including a crankcase, a crankshaft extending from the crankcase, a cylinder block, a blower scroll fastened to the crankcase, wherein the blower scroll includes a bottom and a sidewall, wherein the bottom has an opening through which the crankshaft extends, and wherein the sidewall extends from the bottom away from the crankcase and includes an outlet opening adjacent the cylinder block, a blower housing fastened to the blower scroll without threaded fasteners, wherein the blower housing, the bottom, and the sidewall define a blower scroll chamber, and a fan coupled to the crankshaft and located in the blower scroll chamber such that substantially all of the air moved by the fan exits the blower scroll chamber through the outlet opening.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DESCRIPTION OF THE EXEMPLARY EMBODIMENTS

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
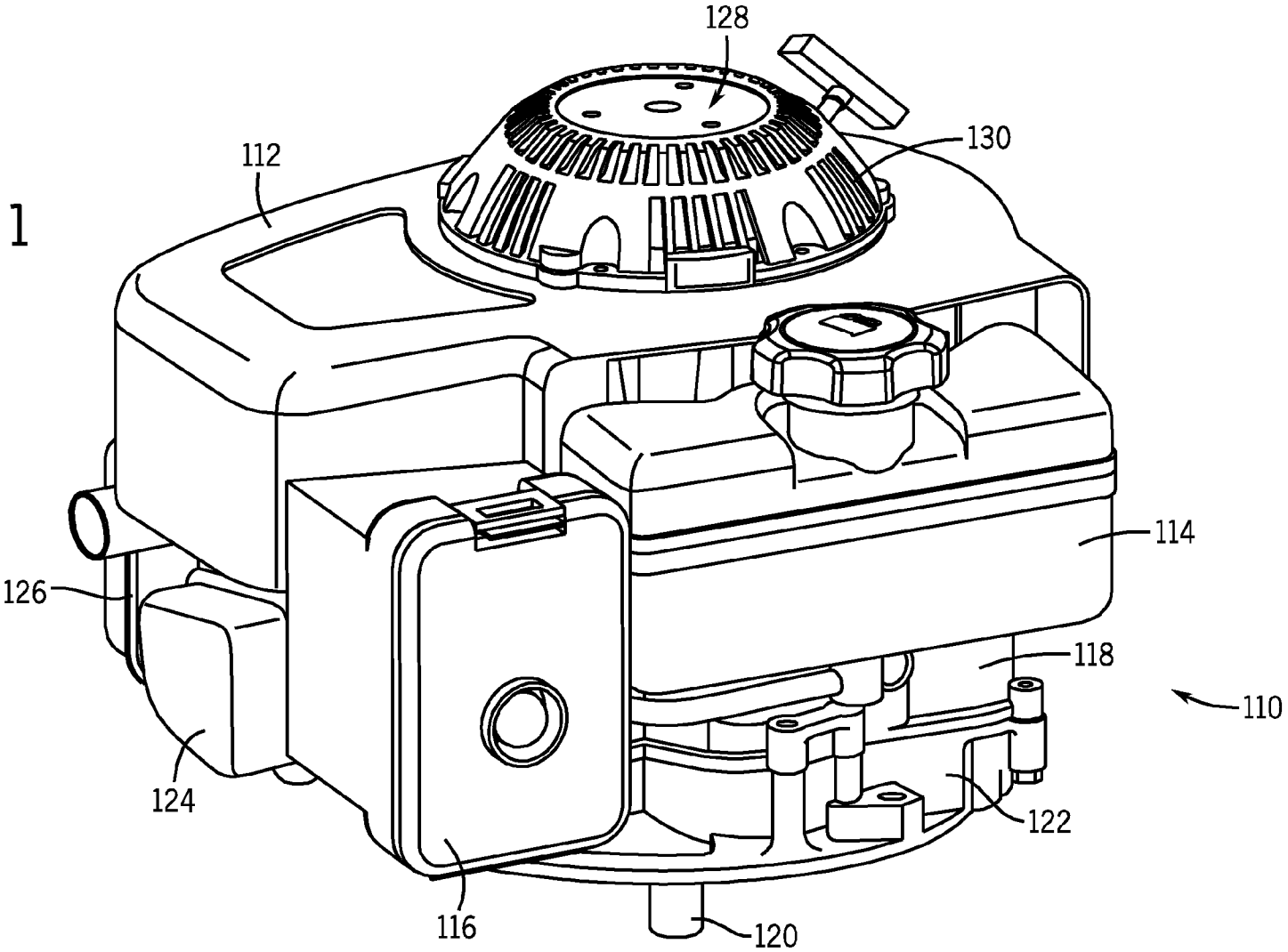
FIG. 1 is a perspective view of an engine according to an exemplary embodiment.

FIG. 1 shows a combustion engine 110 according to an exemplary embodiment. The engine 110 includes a blower housing 112, a fuel tank 114, and an air intake 116 having an air filter. The engine 110 further includes a crankcase 118 having a crankshaft 120 and a sump 122, a rocker cover 124, and a muffler 126. Attached to the top of the blower housing 112 is a recoil starter 128 and a blower intake grate 130 for a blower fan 132 (see FIG. 4).

The blower housing 112 covers moving parts of the engine 110, such as the blower fan 132, shielding the parts from foreign objects, such as sticks, twigs, ropes, cords, hoses, and the like. Further, the blower housing 112 provides heat protection, because air moving with the blower housing insulates the blower housing walls from heat of the engine 110. The blower housing may be formed from a plastic or polymer with low thermal conductivity. In other embodiments, the blower housing may be metal or a composite.

Figure 2:
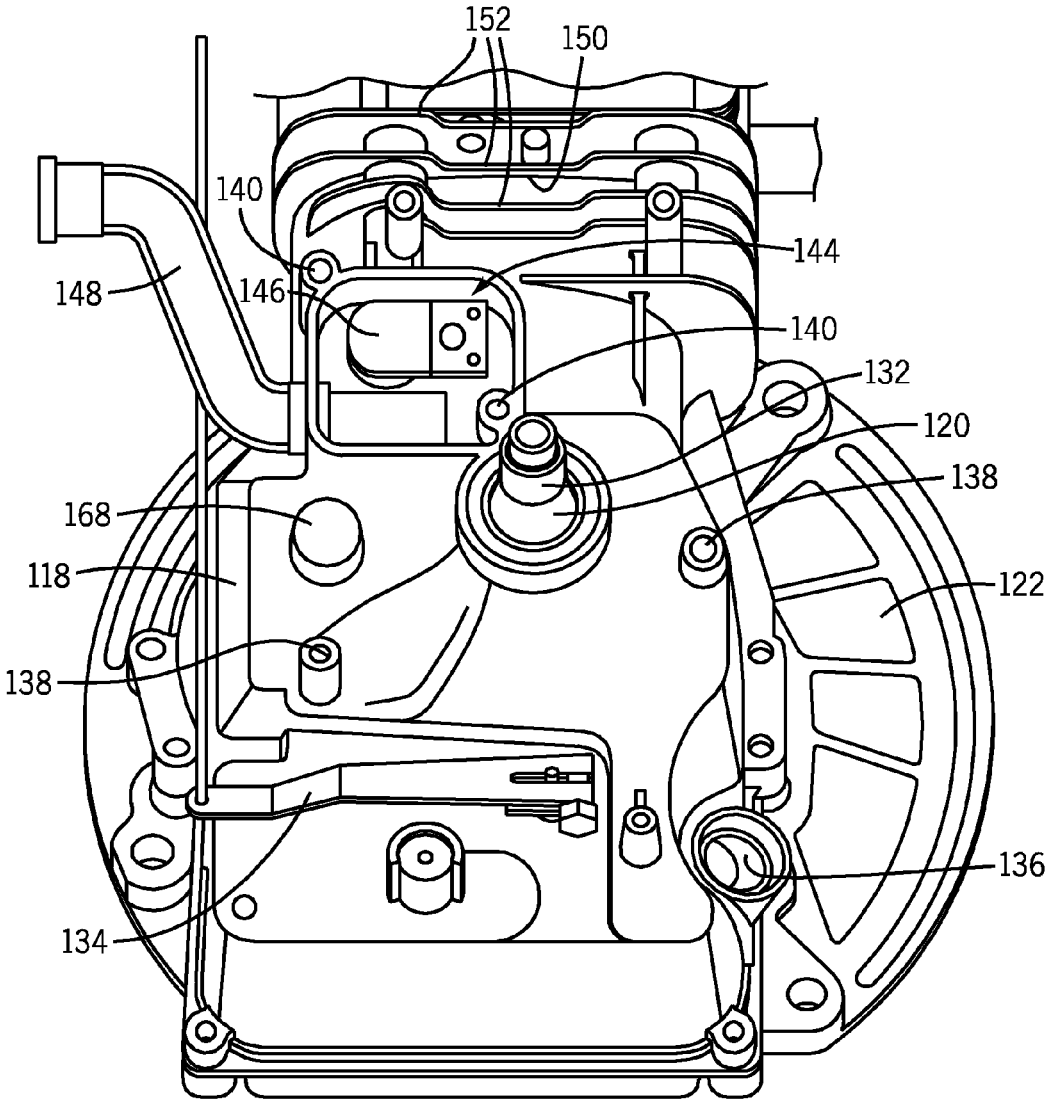
FIG. 2 is a perspective view of a crankcase according to an exemplary embodiment.

FIG. 2 shows a top-down perspective view of the crankcase 118 (with various engine components not shown to better display the crankcase structure). A top portion of the crankshaft 120 extends from the top surface of the crankcase 118. A governor assembly 134 is used to control engine speed. An oil port 136 is shown, which allows a user to pour lubricant into the crankcase 118, pooling in the sump 122. Several fastening holes 138, 140 are formed in the crankcase 118, which allow threaded fasteners to be inserted to attach various components to the crankcase 118, such as a base 142 of a blower scroll (see FIGS. 3A and 3B).

Figure 3A:
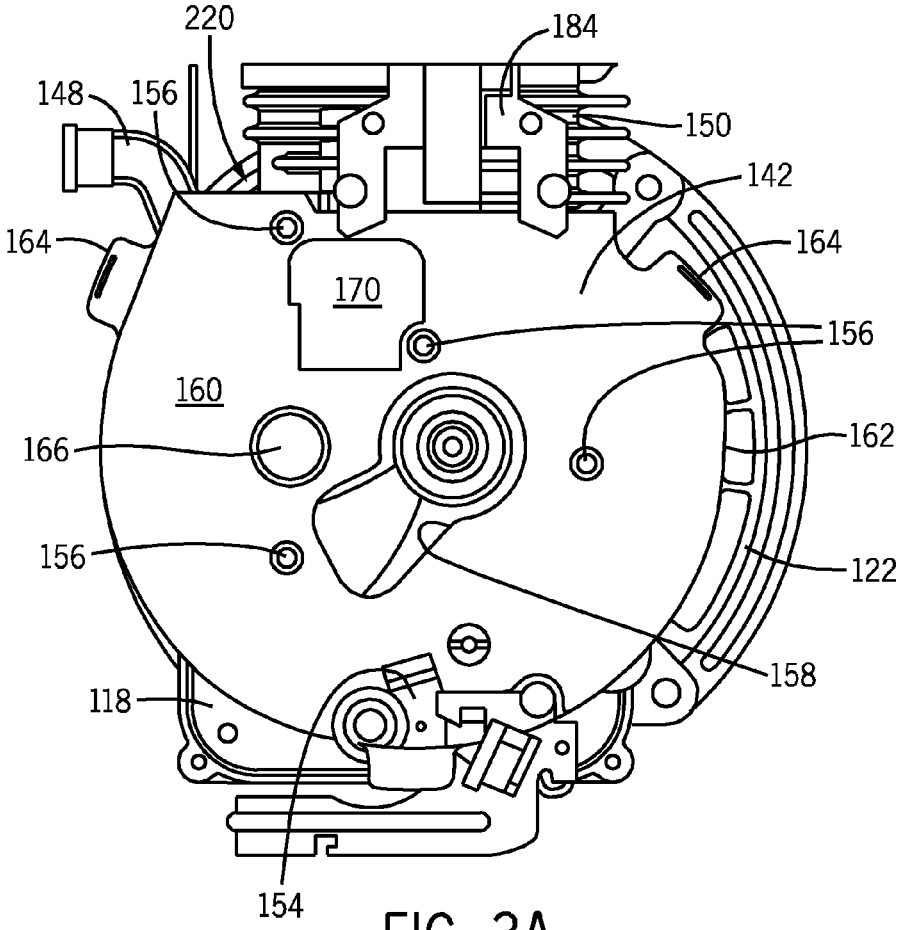
FIG. 3A is a top view of a base of a scroll attached to the crankcase of FIG. 2 according to an exemplary embodiment.

As shown in FIG. 2, the engine 110 includes a breather assembly having a breather valve, shown in FIG. 2 as a one-way reed valve 146 that functions as a check valve. Air released from the crankcase 118 enters a collection area 144. Referring to FIG. 3A, the collection area 144 is enclosed by a portion of the base 142 of a blower scroll. Fastener holes 140 are proximate to the breather collection area 144 for attaching the base 142 to achieve an improved seal. Air released from the crankcase 118 is directed from the collection area 144 to the air intake 116 via a conduit 148, such as a tube or other piping.

Still referring to FIG. 2, the cylinder block 150 includes cooling fins 152. The fins 152 increase the surface area of the cylinder block 150, increasing convection heat transfer between the cylinder block 150 and passing air.

Figure 3B:
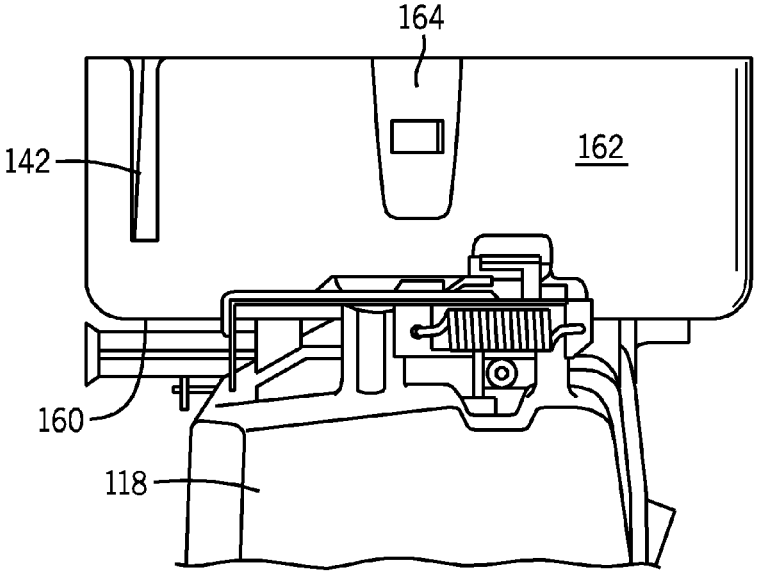
FIG. 3B is a side view of the base of a scroll of FIG. 3A.

FIGS. 3A and 3B show the base 142 of a blower scroll from two perspectives: FIG. 3A shows the base 142 from the top down, and FIG. 3B shows a rear side view. Also shown are a brake assembly 154, the crankcase 118 with the sump 122, the cylinder block 150, and the breather conduit 148. The base 142 includes an opening 158 sized to allow the top portion of the crankshaft 120 to extend through the base 142. As such, the base 142 fits over the crankshaft 120 and fastens to the crankcase 118 via threaded fasteners 156, such as screws or bolts, in the fastening holes 138, 140. In other embodiments, the base 142 is attached to the crankcase 118 with other types of fasteners, such as glues, welds, hooks, latches, pins, etc. In some embodiments, the base 142 is formed from a metal, such as aluminum or steel.

The structure of the base 142 shown in FIGS. 3A and 3B includes a substantially flat bottom 160 and a sidewall 162 extending around the periphery of the bottom 160. As shown in FIG. 3B, the sidewall 162 extends substantially perpendicularly from the flat bottom 160, where the corner between the sidewall 162 and the bottom 160 is rounded. Although substantially flat, the bottom 160 includes a round protrusion 166 extending slightly upward. The round protrusion 166 fits over a corresponding boss 168 on the crankcase 118.

The bottom 160 of the base 142 includes a protrusion 170 in the shape of the breather collection area profile. When the base 142 is fastened to the crankcase 118, the protrusion 170 partially extends into the breather collection area 144, closely fitting against the walls of the breather collection area 144. With the fasteners 156 engaged, the protrusion 170 of the base 142 seals the breather collection area 144, preventing leakage of air (possibly carrying fuel and oil) from the breather assembly. While FIG. 3A shows four fasteners 156, other embodiments may include more or fewer fasteners, and the fasteners may be positioned in different locations than shown. In other embodiments, the base 142 does not include a protrusion 170. In such embodiments, the base 142 may still seal the breather collection area 144. Some embodiment employ gaskets, such as solid and liquid gaskets to improve the seal.

Figure 4:
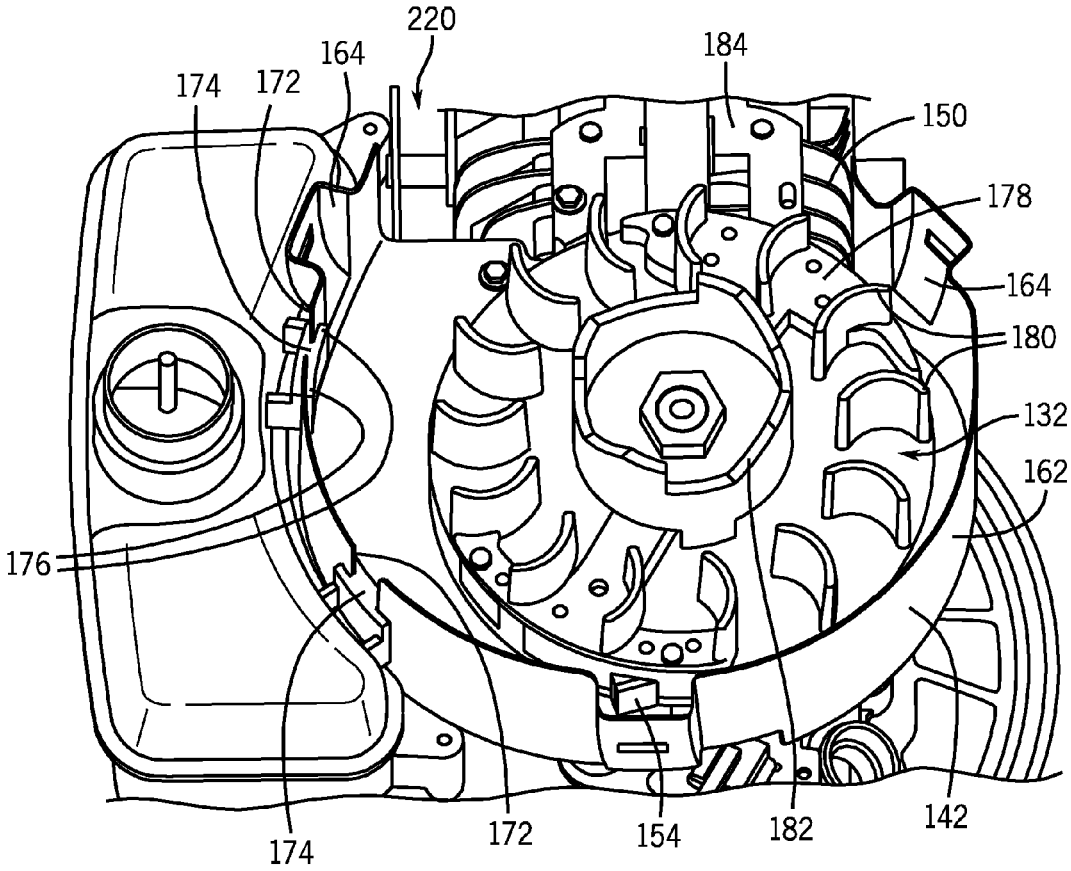
FIG. 4 is a perspective view of the base of a scroll of FIG. 3A with a fan and a fuel tank according to an exemplary embodiment.

The sidewall 162 includes slots 164 for attaching the blower housing 112 to the base 142 and grooves 172 (see FIG. 4) for attaching the fuel tank 114. The slots 164 and grooves 172 allow the blower housing 112 and the fuel tank 114 to be coupled to the sidewall 162 without the use of separate fasteners. In other embodiments, one or more fasteners may be used in conjunction with the fuel tank 114 to attach the fuel tank 114 to the blower housing 112 or the cylinder block 150. For example, FIG. 4 shows a top-down perspective view of the base 142, also showing attachment extensions 174 of the fuel tank 114. The extensions 174 include flanges 176 that slide into the grooves 172 and hook to the sidewall 162 within the grooves 172. Attaching the blower housing 112 to the base 142 locks the extensions 174 into the grooves 172, because a bottom edge of the blower housing 112 blocks upward movement of the extensions 174.

FIG. 4 also shows an ignition armature 184 and a flywheel 178 having an array of fan blades 180. As the flywheel 178 spins, the fan blades 180 drive air from the flywheel 178 toward the sidewall 162. According to an exemplary embodiment, the fan 132 is integral with the flywheel 178, which is attached to the crankshaft 120. In other embodiments, a fan may be a separate piece attached to a flywheel or separate from the flywheel. In other embodiments, the fan blades are not integral with the flywheel 178, and are instead fastened to the flywheel 178 or attached to a separate fan base altogether. Within the center of the flywheel 178 is a recoil starter cup 182. In other embodiments, a post or a cup is integrated into flywheel 178 for transferring recoil starter rotation to the flywheel 178. Ratcheting arms in the recoil starter 128 catch surfaces of the cup 182, transferring rotational power from the recoil starter 128 to the crankshaft 120.

As shown in FIGS. 3A and 4, the sidewall 162 does not extend fully around the periphery of the bottom 160. An opening 220 in the sidewall 162 of the base 142 directs air driven by the fan blades 180 out of the base 142 (and blower housing 112) and across the cylinder block 150 and cylinder head. Increased airflow over the cylinder block 150 increases the rate of convection heat transfer away from the cylinder block 150. Continuity of the base 142 (i.e., absence of many openings in the sidewall 162 and bottom 160) efficiently controls the flow of air toward the cylinder block 150. For example, in some embodiments, a theoretical percentage of the blower air flow that flows out of the opening 220 in the sidewall 162 exceeds 80%, preferably 90%, and even more preferably 95% of the total blower air flow volume entering the blower housing 112.

Figure 5A:
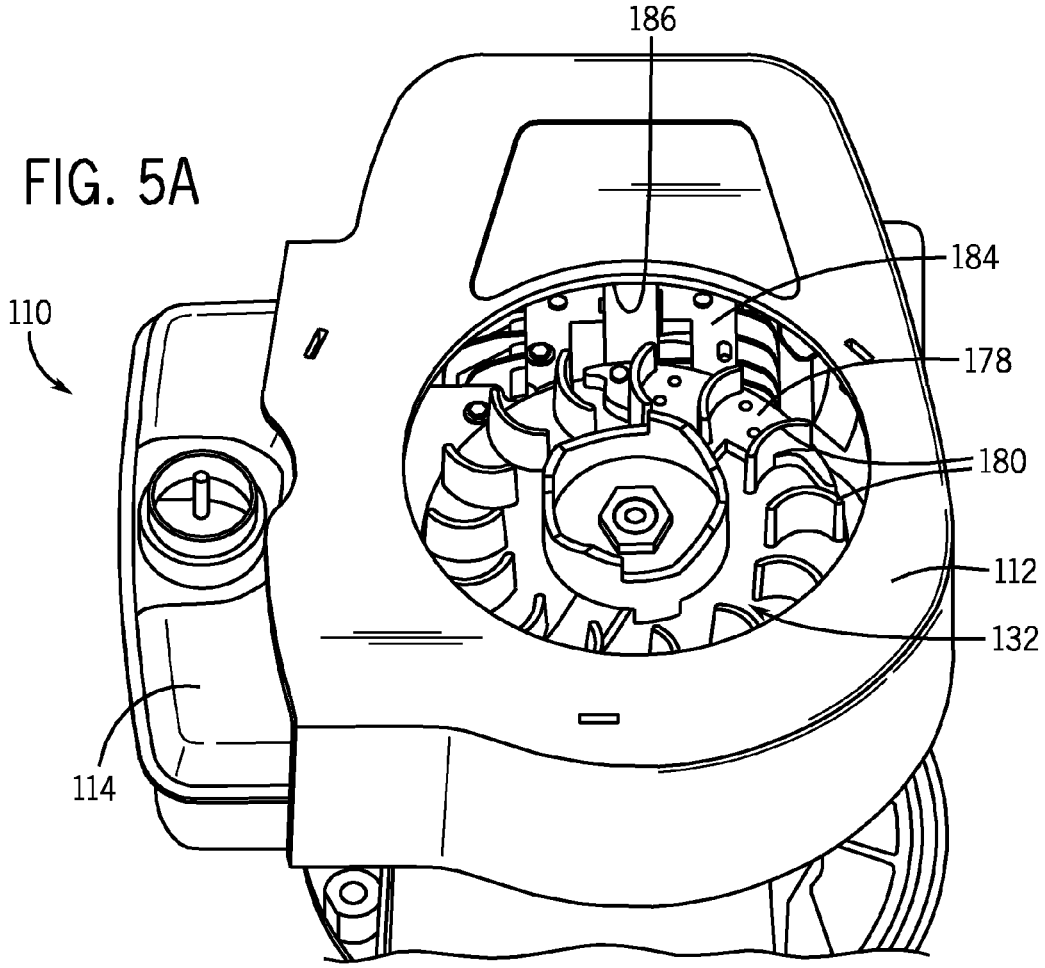
FIG. 5A is a perspective view of a blower housing fastened to an engine.

FIG. 5A shows the engine 110, with the blower housing 112 mounted over the base 142 (compare with FIG. 4). Together the base 142 and the blower housing 112 form a blower scroll chamber. Air enters the chamber through an opening 186 (i.e., inlet) in the top of the blower housing 112, beneath the recoil starter 128 (see FIG. 1), and is directed onto the flywheel 178. The fan blades 180 then drive the air to the exterior of the chamber, to the sidewall 162 and blower housing 112, which directs the air through the opening 220 (i.e., outlet) in the sidewall 162 and over the cylinder block 150 to be cooled.

Figure 5B:
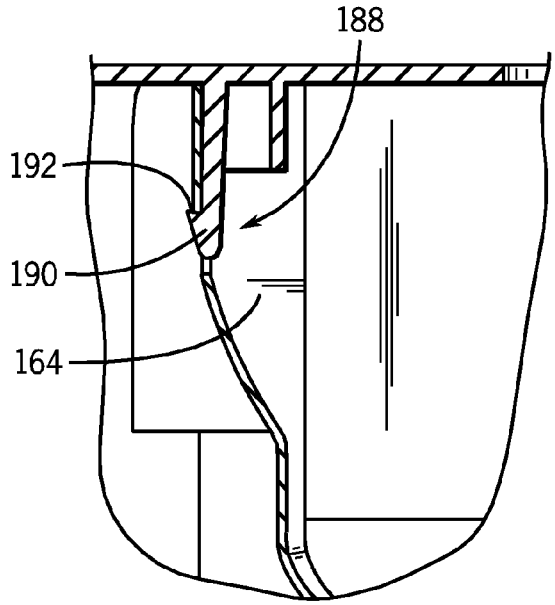
FIG. 5B is a sectional view of a fastener attaching the blower housing of FIG. 5A to the base of a scroll of FIG. 3A, according to an exemplary embodiment.

FIG. 5B shows a fastener according to an exemplary embodiment. The fastener is in the form of a catch 188 including a hook 190 that is integral with the blower housing 112, and a catch point 192 in the slot 164 that is integral with the base 142. To attach the blower housing 112, the hook 190 is aligned over the slot 164, and the blower housing is lowered until the hook "clicks" into the catch point 192. A surface of the catch point 192, substantially perpendicular to the interface of the blower housing 112 and the base 142, holds the flange of the hook 190 in place. The catch 188 allows a user to attach the blower housing 112 to the base 142 without using threaded fasteners; without using fasteners that are separate from the blower housing 112 and the base 142, such as separate screws, bolts, etc.; and without using tools, such as screwdrivers, welding equipment, etc. Other embodiments include a catch point on the blower housing and a hook extending from the base of a blower scroll. In still other embodiments, threaded fasteners may be used in conjunction with the fasteners described.

Figure 6A:
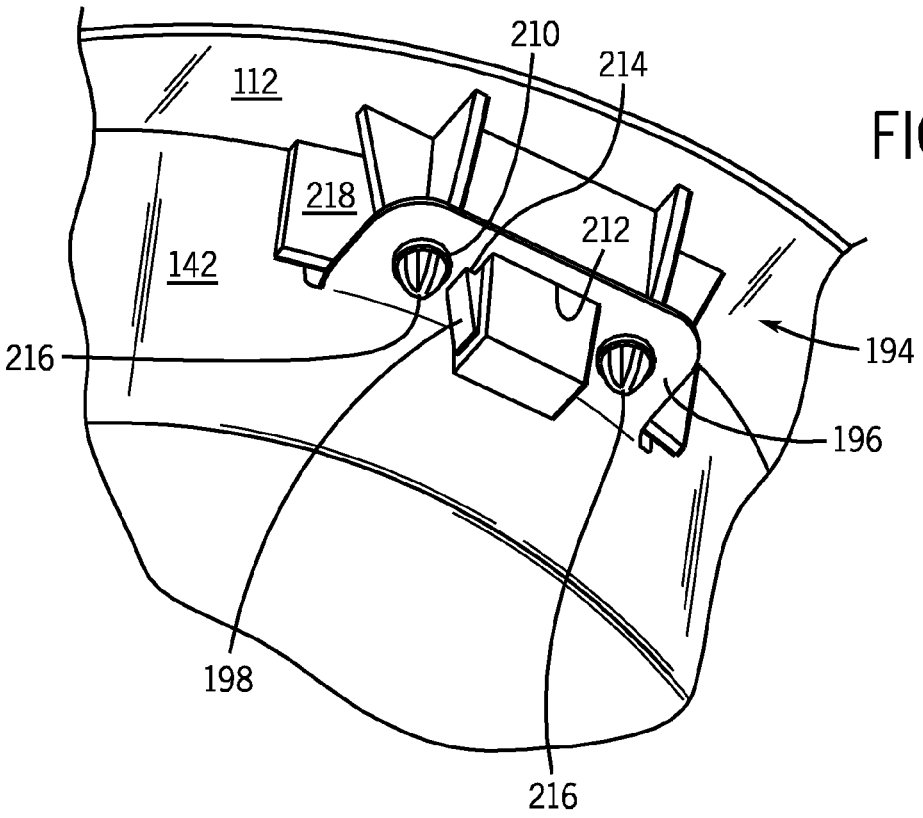
FIG. 6A is a first perspective view of a fastener according to another exemplary embodiment.
Figure 6B:
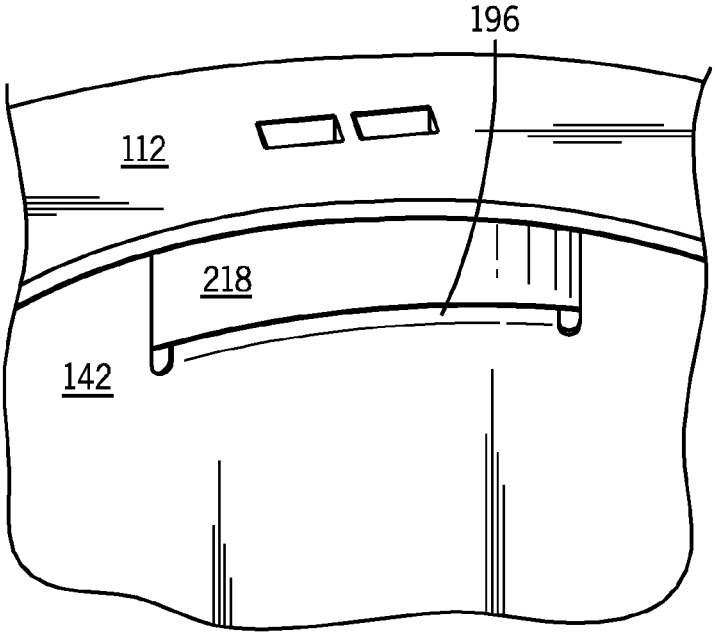
FIG. 6B is a second perspective view of the fastener of FIG. 6A.

FIGS. 6A and 6B show an alternate embodiment of a fastener. FIG. 6A shows an upwardly directed perspective view of the side of the base 142 fastened to the blower housing 112, from the outside the base 142 of the blower scroll. FIG. 6B shows a downwardly directed perspective view of the side of the base 142 fastened to the blower housing 112, from inside the base 142. Like the catch 188 shown in FIG. 5B, the fastener shown in FIGS. 6A and 6B is also in the form of a catch 194 including a hook 198 and corresponding catch point 214. The hook 198 extends through an opening 212 in a flange 196 (or fold) of the base 142. In addition to the hook 198 and catch point 214, the fastener further includes guide bosses 216 ending through openings 210 in the flange 196, and a support 218 that rests on the flange 196. The fastener is designed to absorb vibratory loading of the engine 110, providing a wide surface area to reduce effects of abrasive wear between the base 142 and the blower housing 112.

The construction and arrangements of the engine blower scroll, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. In some embodiments, the engine blower scroll includes internal fins to create vortices, further enhancing the air flow to the desired surfaces for improved convection cooling. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A blower system for an engine, comprising:

a base of a blower scroll, the base coupled to an engine crankcase, the base positioned adjacent the crankcase, the base having a bottom wall with an opening formed therein to accommodate an end of a crankshaft, and the base further having a sidewall extending away from the crankcase;

a blower housing fastened to the base without the use of threaded fasteners, wherein the blower housing and the base form a chamber having an inlet and an outlet; and a fan within the chamber and driven by the crankshaft, the fan configured to blow air through the outlet.

2. The system of claim 1, wherein the blower housing is fastened to the base with a catch.

3. The system of claim 2, wherein the catch includes a hook extending from the blower housing.

4. The system of claim 3, wherein the sidewall includes a flange that supports the blower housing, the hook extending through the flange.

5. The system of claim 4, wherein the flange includes an opening and the blower housing includes a boss sized to slide into the opening.

6. The system of claim 5, wherein the blower housing is fastened to the base with more than one catch coupled to the sidewall.

7. The system of claim 6, wherein the base further comprises grooves in the sidewall, wherein the grooves are configured to support hooking extensions of a fuel tank.

8. An engine, comprising:

a base of a blower scroll, the base coupled to an engine crankcase, the base positioned adjacent the crankcase, and the base having a bottom with an opening formed therein and a sidewall extending away from the crankcase;

a blower housing coupled to the base, wherein the blower housing and the base together form a chamber of the blower scroll;

a fan extending within the chamber, the fan driven by a crankshaft extending through the opening in the base, wherein the chamber has an outlet oriented to direct a flow of air over a cylinder block; and a fuel tank coupled to the sidewall of the base.

9. The engine of claim 8, wherein the fuel tank includes an extension having a flange, the flange hooking to the sidewall.

10. The engine of claim 9, wherein the sidewall includes a groove, wherein the extension of the fuel tank slides into the groove to attach the fuel tank.

11. The engine of claim 10, wherein the blower housing attaches to the base such that an edge of the blower housing locks the extension within the groove.

12. The engine of claim 11, wherein the blower housing fastens to the base via a catch, and without threaded fasteners.

13. The engine of claim 12, wherein the base forms a wall sealing a collection area behind a crankcase breather.

14. The engine of claim 8, wherein the fuel tank fastens to the sidewall without threaded fasteners.

15. An engine, comprising:

a crankcase;

a crankshaft extending from the crankcase;

a cylinder block;

a blower scroll fastened to the crankcase, the blower scroll positioned adjacent the crankcase, wherein the blower scroll includes a bottom and a sidewall, wherein the bottom has an opening through which the crankshaft extends, and wherein the sidewall extends from the bottom away from the crankcase and includes an outlet opening adjacent the cylinder block;

a blower housing fastened to the blower scroll without threaded fasteners, wherein the blower housing, the bottom, and the sidewall define a blower scroll chamber; and a fan coupled to the crankshaft and located in the blower scroll chamber such that substantially all of the air moved by the fan exits the blower scroll chamber through the outlet opening.

16. The engine of claim 15, wherein the blower housing is fastened to the blower scroll with a catch.

17. The engine of claim 16, wherein the catch includes a hook extending from the blower housing.

18. The engine of claim 17, wherein the sidewall includes a flange that supports the blower housing, the hook extending through the flange.

19. The engine of claim 18, wherein the flange includes an opening and the blower housing includes a boss sized to slide into the opening.

20. The engine of claim 15, further comprising:

a fuel tank fastened to the sidewall without threaded fasteners.

* * * * *